US006769196B2

(12) United States Patent
Park et al.

(10) Patent No.: US 6,769,196 B2
(45) Date of Patent: Aug. 3, 2004

(54) CONDENSING TYPE CLOTHES DRYER AND CONDENSER THEREOF

(75) Inventors: Young Hwan Park, Kyonggi-Do (KR); Choon Myun Chung, Kyonggi-Do (KR); Mu Yong Choi, Seoul (KR); Dae Yun Park, Kyonggi-Do (KR); Kyung Seop Hong, Inchon-kwangyokshi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/405,356

(22) Filed: Apr. 3, 2003

(65) Prior Publication Data

US 2004/0035019 A1 Feb. 26, 2004

(30) Foreign Application Priority Data

Aug. 21, 2002 (KR) ..... 10-2002-49487

(51) Int. Cl.[7] ..... F26B 21/06

(52) U.S. Cl. ..... 34/77; 34/73; 34/78; 34/595; 165/179; 165/182; 165/913

(58) Field of Search ..... 34/73, 74, 75, 34/76, 77, 78, 595; 165/913, 179, 146, 181, 185, 182, 184

(56) References Cited

U.S. PATENT DOCUMENTS 1,524,520 A * 1/1925 Junkers ..... 165/146
2,122,504 A * 7/1938 Wilson ..... 165/184
2,512,540 A * 6/1950 Friedman ..... 165/146
3,022,982 A * 2/1962 Demalander ..... 165/129
4,621,438 A * 11/1986 Lanciaux ..... 34/77

FOREIGN PATENT DOCUMENTS

| | | |
|---|---|---|
| DE | 80 17 935 U1 | 10/1980 |
| EP | 0 982 427 A1 | 3/2000 |
| GB | 2 082 741 A | 3/1982 |

* cited by examiner

*Primary Examiner*—Ira S. Lazarus
*Assistant Examiner*—Kathryn S. O'Malley
(74) *Attorney, Agent, or Firm*—Birch, Stewart, Kolasch & Birch, LLP

(57) ABSTRACT

A condenser of a condensing-type clothes dryer includes a plurality of condensing ducts provided in a middle portion of a circulation duct, the condensing ducts condensing air being circulated there-through after being discharged from a drum; and a plurality of cooling fins provided to be in contact with an outer surface of the condensing ducts, wherein an interval or a pitch of the cooling fins is different partially according to a flow rate of air blown from a cooling fan for a heat-exchange with air flowing through the condensing duct. At this time, the pitch or interval of the cooling fins is narrow at a portion where air blown from the cooling fan flows fast, and the pitch or internal of the cooling fins is wide at a portion where air blown from the cooling fan flows slowly.

20 Claims, 6 Drawing Sheets

CONDENSING TYPE CLOTHES DRYER AND CONDENSER THEREOF

This application claims the benefit of the Korean Application No. P2002-49487 filed on Aug. 21, 2002, which is hereby incorporated by reference.

BACKGROUND OF THE INVENTION

1. Field of the Invention

The present invention relates to a clothes dryer, and more particularly, to a condensing type clothes dryer including a condenser having good heat-exchange efficiency.

2. Discussion of the Related Art

In general, a clothes dryer is an apparatus for drying clothes by removing moisture from wet clothes (laundry) with a blast of a hot air from a heater. The clothes dryer is largely classified into an exhausting-type drying machine and a condensing-type drying machine according to a method for processing humid air generated while drying the wet clothes. In the exhausting-type clothes dryer, the humid air generated while drying the wet clothes in a drum is exhausted to the outside of the drying machine. Meanwhile, in the condensing-type clothes dryer, moisture in the air is condensed, and thereby removed from the humid air. After that, the resulting dry air flows into the inside of the drum, thereby re-circulating the dry air in the drum.

According to the aforementioned related art, the condensing-type clothes dryer is generally provided with a cylinder-shaped drum, a circulation duct, a circulation fan, a heater, a condenser, a cooling fan, and a filter. The cylinder-shaped drum receiving the wet clothes (laundry) therein is connected to a driving motor by a belt, to rotate the drum. The circulation duct forms a circulation passage for air inside the drum, and the circulation fan circulates the air inside the drum through the circulation duct. Also, the heater heats the circulation air, and the condenser removes moisture from the humid circulation air. The cooling fan sends cool external air to the condenser, and the filter removes particles such as nap from the circulation air in the drum.

Referring to FIG. 1, the condenser of the related art condensing-type clothes dryer is provided with a plurality of condensing ducts 1*a* and a plurality of cooling fins 1*b*. The cooling fins 1*b* contact the condensing ducts 1*a* between the respective condensing ducts 1*a*.

The condensing ducts 1*a* are connected to the center portion of the circulation ducts, so that the air including moisture the moist is circulated in the condensing ducts 1*a* as shown by an arrow 1 of FIG. 1. Generally, the cooling fins 1*b* have cross-sectional areas of waveforms, which are respectively provided between the condensing ducts 1*a*. At this time, pitches of the cooling fins 1*b* are equally formed.

The heat-exchange of the condenser in the related art condensing-type clothes dryer will be described with reference to FIG. 2.

Referring to FIG. 2, the humid air generated by drying the wet clothes in the drum is flowed into the inside of the plurality of condensing duct 1*a,* and the cool external air blown from the cooling fan 2 at one side of the condenser 1 is flowed into a portion having the cooling fins 1*b* between the condensing ducts 1*a* at the same time. Thus, the humid air passing through the inside of the condensing duct 1*a* makes a heat-exchange with the cool external air passing through between an outer surface of the condensing duct 1*a* and the cooling fins 1*b,* without being mixed.

That is, the high temperature and humid air flown from the condenser 1 indirectly makes the heat-exchange with the cool external air blown from the cooling fan 2 through the medium of the outer surface of the condensing duct 1*a* and the cooling fins 1*b,* thereby removing the moisture from the humid air by condensing the moisture in the humid air. Thus, the dry air is re-flown into the drum.

However, the related art condenser 1 performing a heat-exchange according to the aforementioned method has problems in that the heat-exchange is not smooth.

As shown in FIG. 2, an external air inlet A of the cooling fan 2 is narrower than an external air outlet B of the condenser 1, so that the external air flow is fast at the center portion of the condenser 1 through which the external air is blown. However, the external air flow is slow at the periphery portions of a longitudinal direction of the condenser 1. In FIG. 2, an arrow II indicates a flow speed of the external air, '3' indicates a driving motor, '4' indicates a duct for guiding the external air blown from the cooling fan 2 to the condenser 1.

Accordingly, the heat-exchange is good at the center portion of the longitudinal direction of the condenser 1 where the external air flows fast since the amount of the external air flown into the condenser 1 is large in a unit time period. Meanwhile, the heat-exchange is poor at the periphery portions of the longitudinal direction of the condenser 1 where the external air flows slowly since the amount of the external air flown into the condenser 1 is small in the unit time period. That is, it is hard to uniformly make the heat-exchange in the entire condenser 1 since the flow speed of the external air flown into the condenser 1 varies, thereby decreasing the heat-exchange efficiency of the condenser 1. Furthermore, the drying efficiency of the condensing-type clothes dryer is deteriorated.

Also, the flow speed of the external air passing through the condenser 1 changes, so that the air flow is unstable, thereby generating noise due to unstable circulation of the air.

SUMMARY OF THE INVENTION

Accordingly, the present invention is directed to a condenser of a condensing-type clothes dryer that substantially obviates one or more problems due to limitations and disadvantages of the related art.

An object of the present invention is to provide to a condenser of a condensing-type clothes dryer, which has good heat-exchange efficiency.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a condenser of a condensing-type clothes dryer includes a plurality of condensing ducts provided in a middle portion of a circulation duct, the condensing ducts condensing air being circulated therethrough after being discharged from a drum; and a plurality of cooling fins provided to be in contact with an outer surface of the condensing ducts, wherein an interval or a pitch of the cooling fins is different partially according to a flow rate of air blown from a cooling fan for heat-exchange with air flowing through the condensing duct.

In another aspect, a condensing-type clothes dryer includes a drum being rotatably provided in a cabinet; a circulation duct connecting an air inlet and outlet of the drum with each other for forming a circulation passage of air inside the drum; a condenser having a plurality of circulation ducts being provided in a middle portion of the circulation ducts the condensing ducts condensing air being circulated there-through after being discharged from the drum, and a plurality of cooling fins provided to be in contact with an outer surface of the condensing ducts, wherein an interval or a pitch of the cooling fins is different partially according to air flow rate for a heat-exchange with air flowing through the condensing duct; a cooling fan provided at one side of the condenser for cooling the condenser; and a motor driving the drum and the cooling fan.

Preferably, the pitch or interval of the cooling fins is narrow at a portion where air blown from the cooling fan flows fast, and the pitch or internal of the cooling fins is wide at a portion where air blown from the cooling fan flows slowly.

Preferably, the cooling fin has a longitudinal-section of a waveform having pitches, which is provided between the condensing ducts.

Preferably, the cooling fins are provided in a board type for being penetrated by the condensing duct.

Preferably, the intervals or pitches of the cooling fins gradually become wider as they move out to a portion where air blown from the cooling fan flows slowly.

Preferably, the intervals or pitches of the cooling fins are equally narrow at a portion where air blown from the cooling fan flows fast, and the intervals of the cooling fins are equally wide at a portion where air blown from the cooling fan flows slowly.

Preferably, the intervals or pitches of the cooling fins gradually become narrower to the center portion of the longitudinal direction of the condenser where air blown from the cooling fan flows fast, and the pitches of the cooling fins are equally wide at a portion where air blown from the cooling fan flows slowly.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
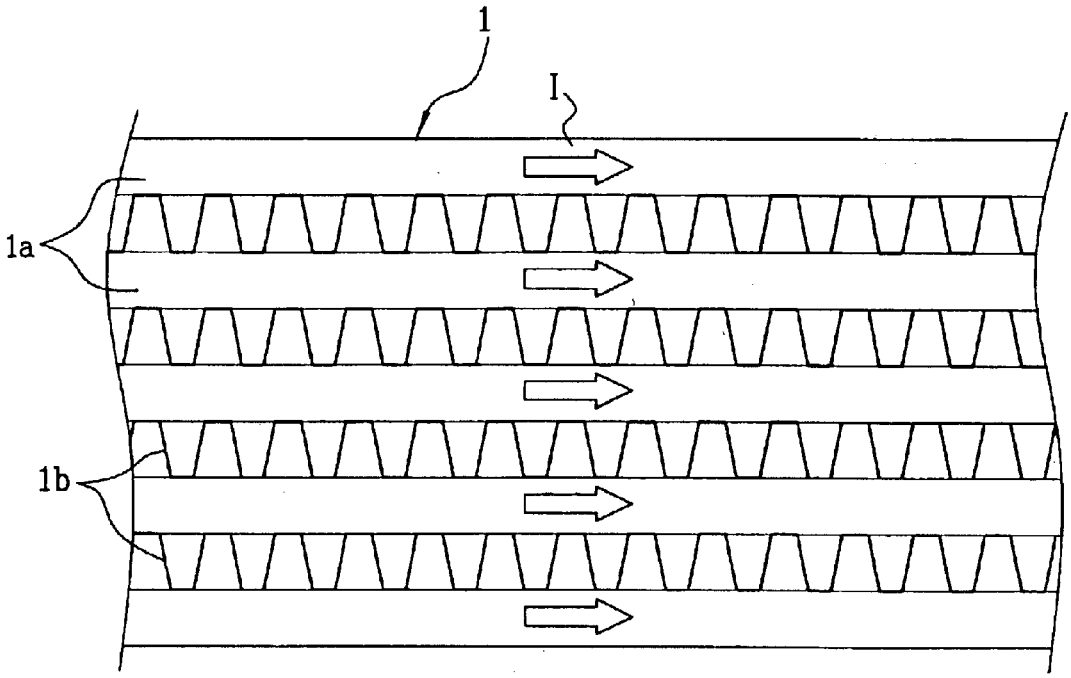
FIG.1 Prior Art
FIG. 1 is a side view illustrating an arrangement of cooling fins in a related art condenser.
Figure 2:
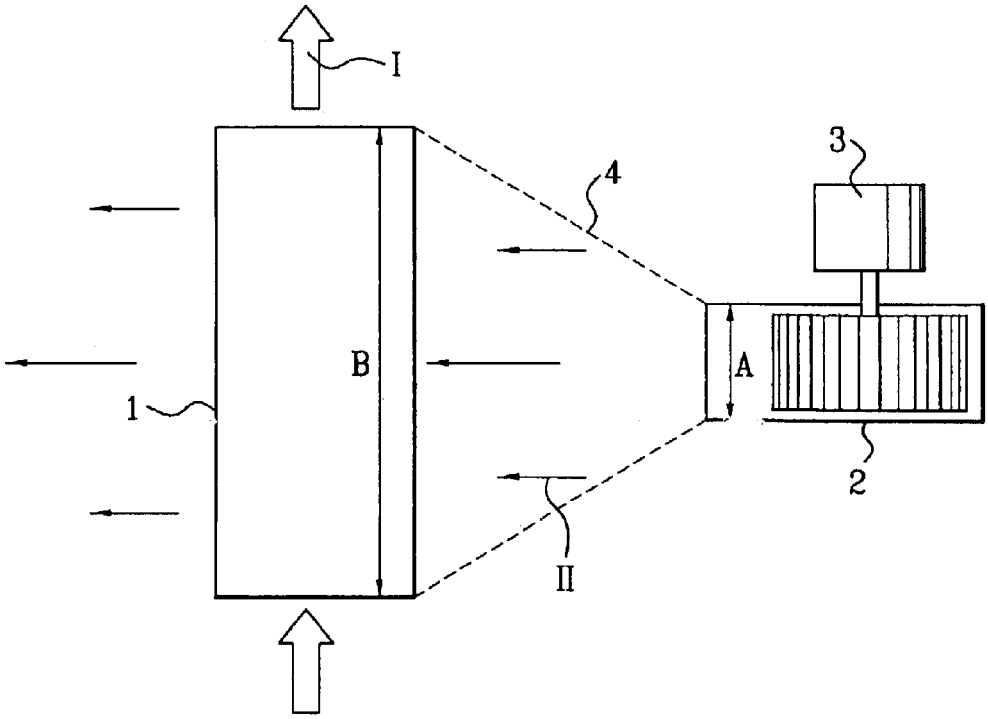
FIG.2 Prior Art
FIG. 2 illustrates a flow speed of external air passing through a related art condenser.
Figure 3:
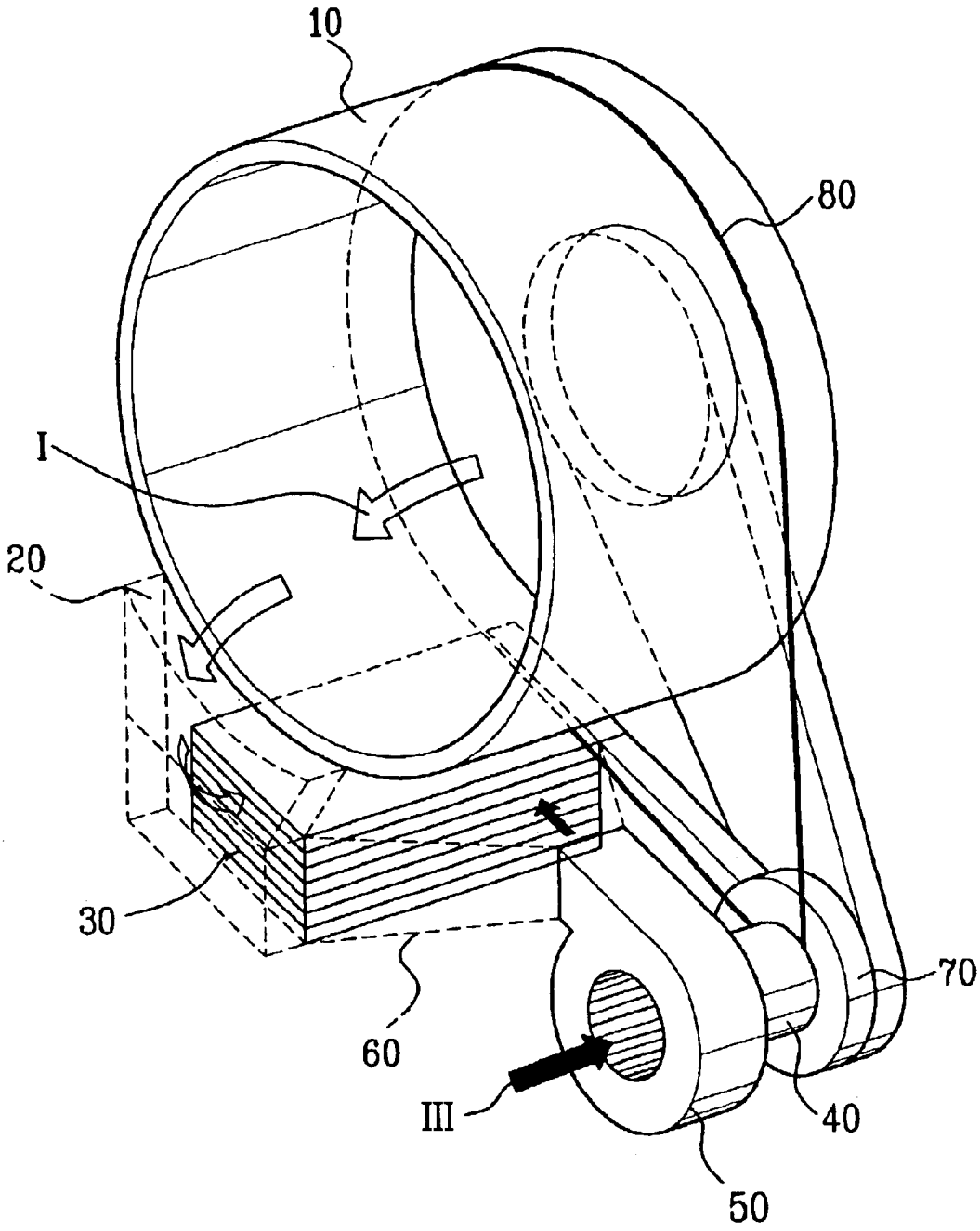
FIG. 3 is a perspective view illustrating a clothes dryer to which the present invention is applied.

A clothes dryer according to the present invention will be described with reference to the accompanying drawings. FIG. 3 illustrates a structure of the clothes dryer according to the present invention. In FIG. 3, an arrow I indicates a flow of a circulation air, and an arrow III indicates a flow of an external air.

Referring to FIG. 3, the condensing-type clothes dryer according to the present invention is provided with a drum 10, a circulation duct 20, a condenser 30, and a cooling fan 50.

At this time, the cylinder-shaped drum 10 having a plurality of lifters (not shown) on an inner surface thereof is rotatably provided in a cabinet (not shown). The clothes are dried in the drum 10 being rotated by a motor 40. In this respect, the drum 10 is connected to the motor 40 by a belt 80.

The circulation duct 20 is provided for connecting an air inlet of the drum 10 to an air outlet of the drum 10, thereby forming a circulation passage of air inside the drum 10. Thus, air used for drying the clothes in the drum 10 flows through the circulation duct 20, and then flows into the inside of the drum 10.

The condenser 30 is provided at a middle portion of the circulation duct 20, so that the circulation air passes through the inside of the circulation duct 20. That is, the condenser 30 condenses moisture in the high humidity air generated inside the drum 10 during drying of the clothes, thereby removing the moisture from the humid air. For this, the cooling fan 50 is provided to be adjacent to the condenser 30, for blowing cool external air into the condenser 30. A duct 60 is for guiding air blown from the cooling fan 50 to the condenser 30.

Meanwhile, the condenser 30 according to the present invention includes a plurality of condensing ducts 30*a*, and a plurality of cooling fins 30*b*, 30*c*, 30*d*, 30*e*, 30*f*, and 30*g*. At this time, the plurality of condensing ducts 30*a* are provided in a middle portion of the circulation duct 20 in which air used for drying the clothes in the drum 10 after being discharged from the outlet of the drum 10 is circulated. The plurality of cooling fins 30*b*, 30*c*, 30*d*, 30*e*, 30*f* and 30*g* are provided to be in contact with an outer surface of the condensing duct 30*a*, in which an interval or a pitch of the cooling fins is different partially according to a flow rate of air blown from the cooling fan 50 for heat-exchange with air flowing through the condensing duct 30*a*. That is, the interval or pitch of the cooling fins is varied according to the flow speed of air blown from the cooling fan 50. For example, in case of that the speed of air blown from the cooling fan 50 is high, the interval or the pitch of the cooling fins decreases. Meanwhile, in case the speed of air from the cooling fan 50 is low, the interval or the pitch of the cooling fins increases.

As shown in FIG. 4, FIG. 6 to FIG. 10, the condenser 30 according to the present invention may have various preferred embodiments by differing the arrangements of the cooling fins 30*b*, 30*c*, 30*d*, 30*e*, 30*f*, and 30*g*. Hereinafter, the condensers according to the preferred embodiments of the present invention will be explained with reference to the accompanying drawings. At this time, an explanation for the structure of the condensing duct 30*a* will be omitted since the structure of the condensing duct 30*a* is same in the respective preferred embodiments.

Figure 4:
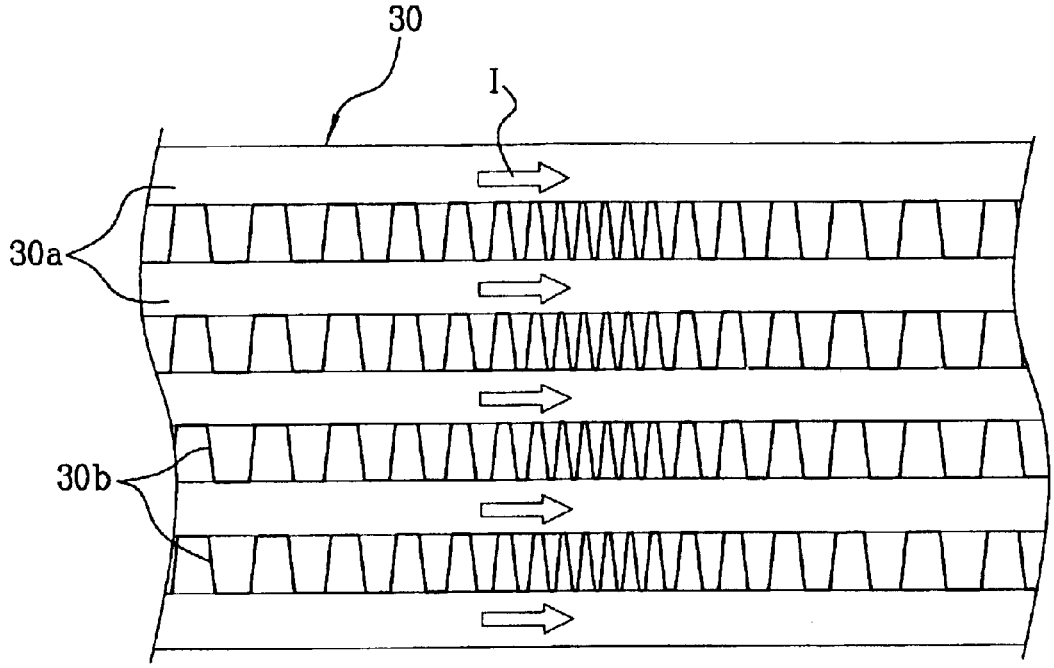
FIG. 4 is a side view illustrating an arrangement of cooling fins in a condenser according to the first embodiment of the present invention.
Figure 6:
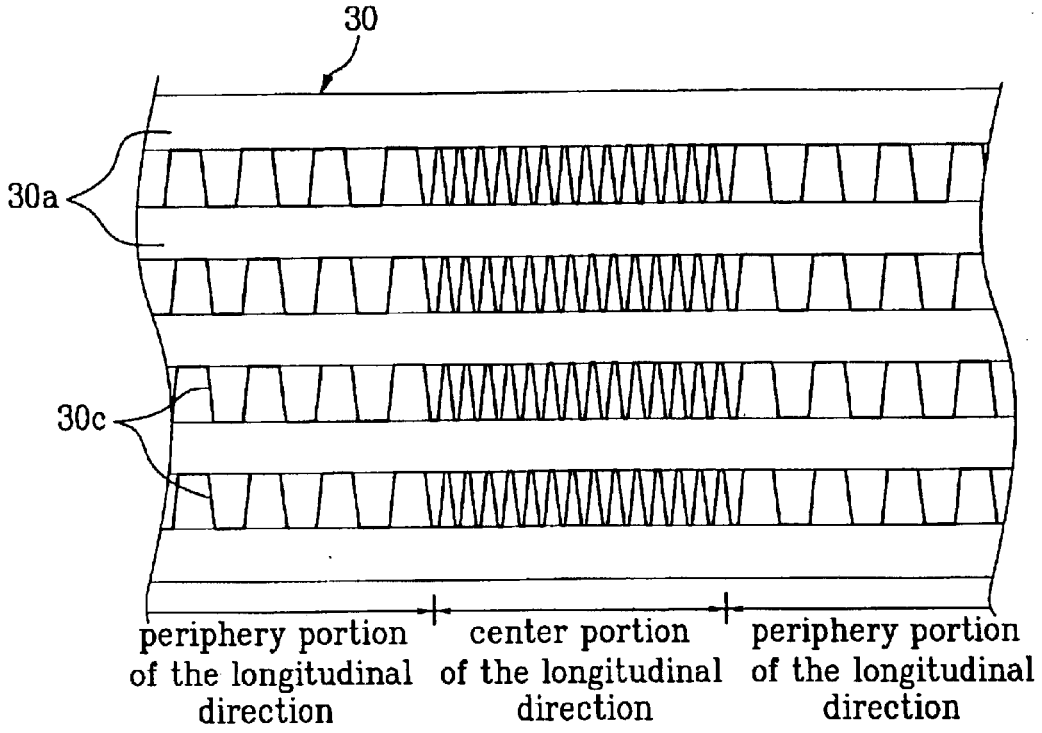
FIG. 6 is a side view illustrating an arrangement of cooling fins in a condenser according to the second embodiment of the present invention.
Figure 7:
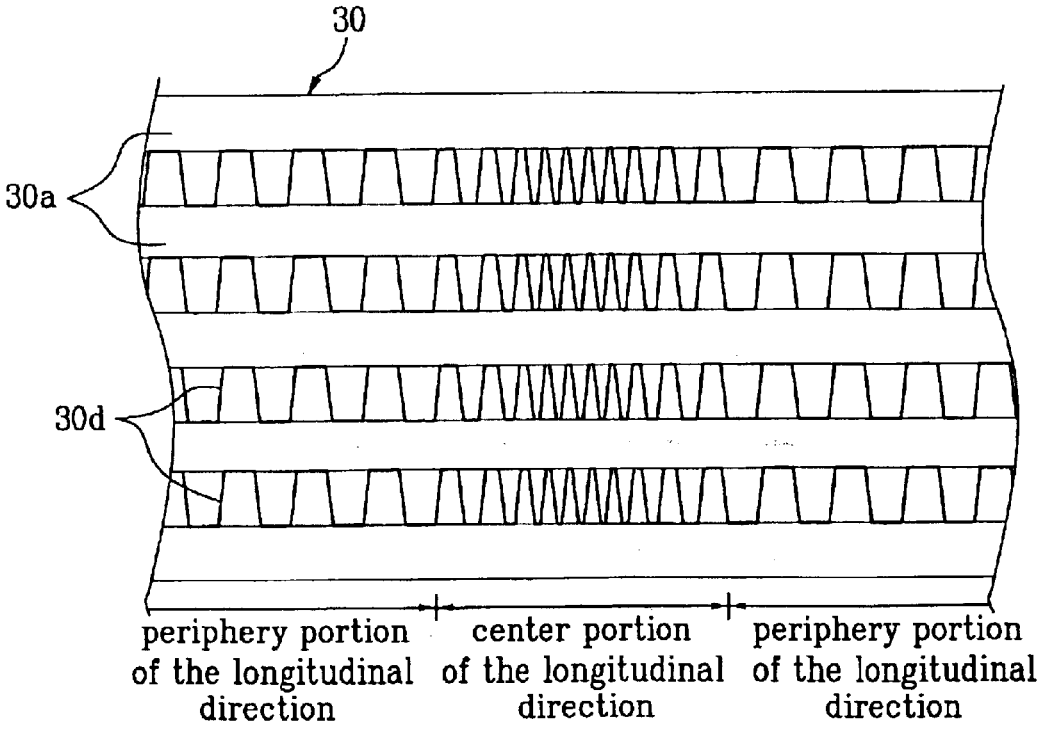
FIG. 7 is a side view illustrating an arrangement of cooling fins in a condenser according to the third embodiment of the present invention.

FIG. 4, FIG. 6 and FIG. 7 are side views respectively illustrating the arrangements of cooling fins in condensers according to the first, second and third embodiments of the present invention. In the aforementioned preferred embodiments of the present invention, the cooling fins 30*b*, 30*c* and 30*d* have cross-sectional areas of waveforms, which are respectively provided between the condensing ducts 30*a*.

Figure 5:
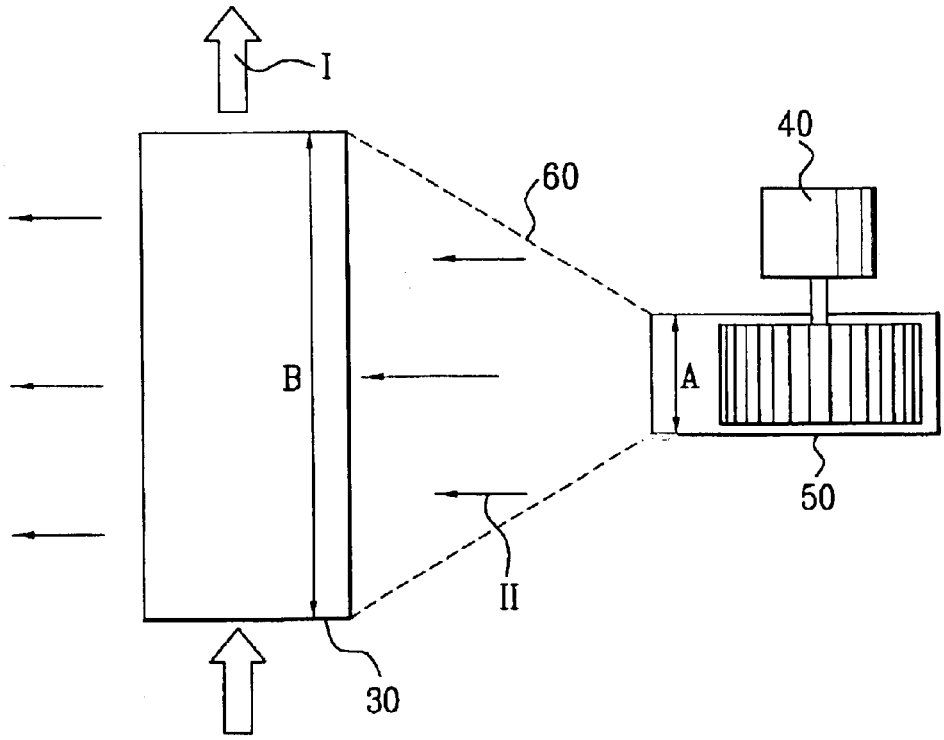
FIG. 5 illustrates a flow speed of an external air passing through a condenser according to the first embodiment of the present invention.

In the condenser according to the first embodiment of the present invention, pitches of the cooling fins 30*b* gradually become wider as they move out to a portion where air blown from the cooling fan 50 flows slowly. For example, as shown in FIG. 4 and FIG. 5, the pitches of the cooling fins 30*b* are narrow at the center portion of a longitudinal direction of the condenser 30 where air flows fast. Meanwhile, the pitches of the cooling fins 30*b* become wider as they move to periphery portions of the longitudinal direction of the condenser 30 where air blown from the cooling fan 50 flows slowly.

In the condenser according to the second embodiment of the present invention, pitches of the cooling fins 30*c* are equally narrow at a portion where air blown from the cooling fan 50 flows fast, and the pitches of the cooling fins 30*c* are equally wide at portions where air blown from the cooling fan 50 flows slowly. For example, as shown in FIG. 6, the pitches of the cooling fins 30*c* are equally narrow at the center portion of the longitudinal direction of the condenser 30 where air blown from the cooling fan 50 flows fast. Meanwhile, the pitches of the cooling fins 30*c* are equally wide at the periphery portions of the longitudinal direction of the condenser 30 where air blown from the cooling fan 50 flows slowly.

In the condenser according to the third embodiment of the present invention, pitches of the cooling fins 30*d* gradually become narrower as they move to the center portion of the longitudinal direction of the condenser 30 where air blown from the cooling fan 50 flows fast. The pitches of the cooling fins 30*d* are equally wide at portions where air blown from the cooling fan 50 flows slowly. For example, as shown in FIG. 7, the pitches of the cooling fins 30*d* gradually become narrower as they approach the center portion of the longitudinal direction of the condenser 30 where air blown from the cooling fan 50 flows fast. The pitches of the cooling fins 30*d* are equally wide at the periphery portions of the longitudinal direction of the condenser 30 where air blown from the cooling fan 50 flows slowly.

Figure 8:
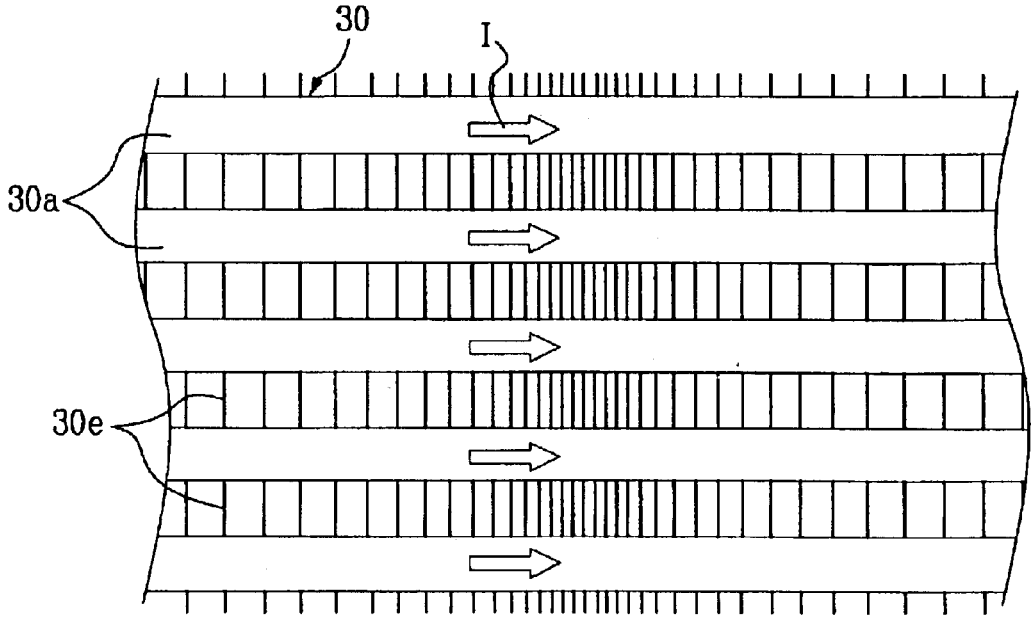
FIG. 8 is a side view illustrating an arrangement of cooling fins in a condenser according to the fourth embodiment of the present invention.
Figure 9:
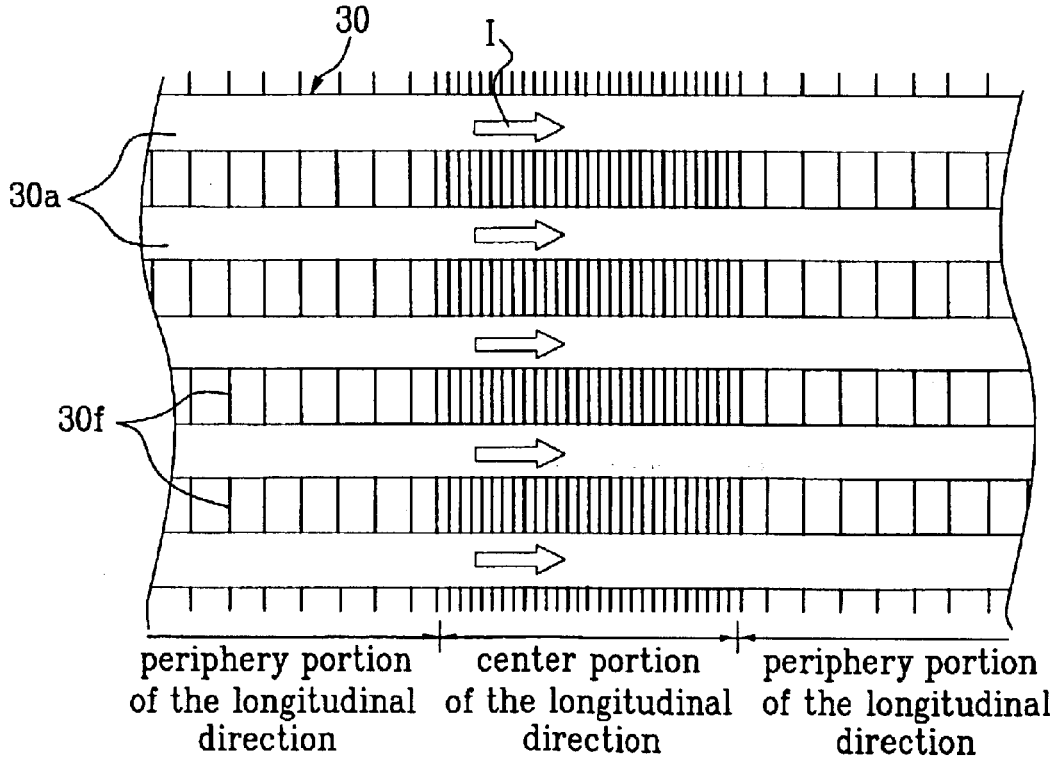
FIG. 9 is a side view illustrating an arrangement of cooling fins in a condenser according to the fifth embodiment of the present invention.
Figure 10:
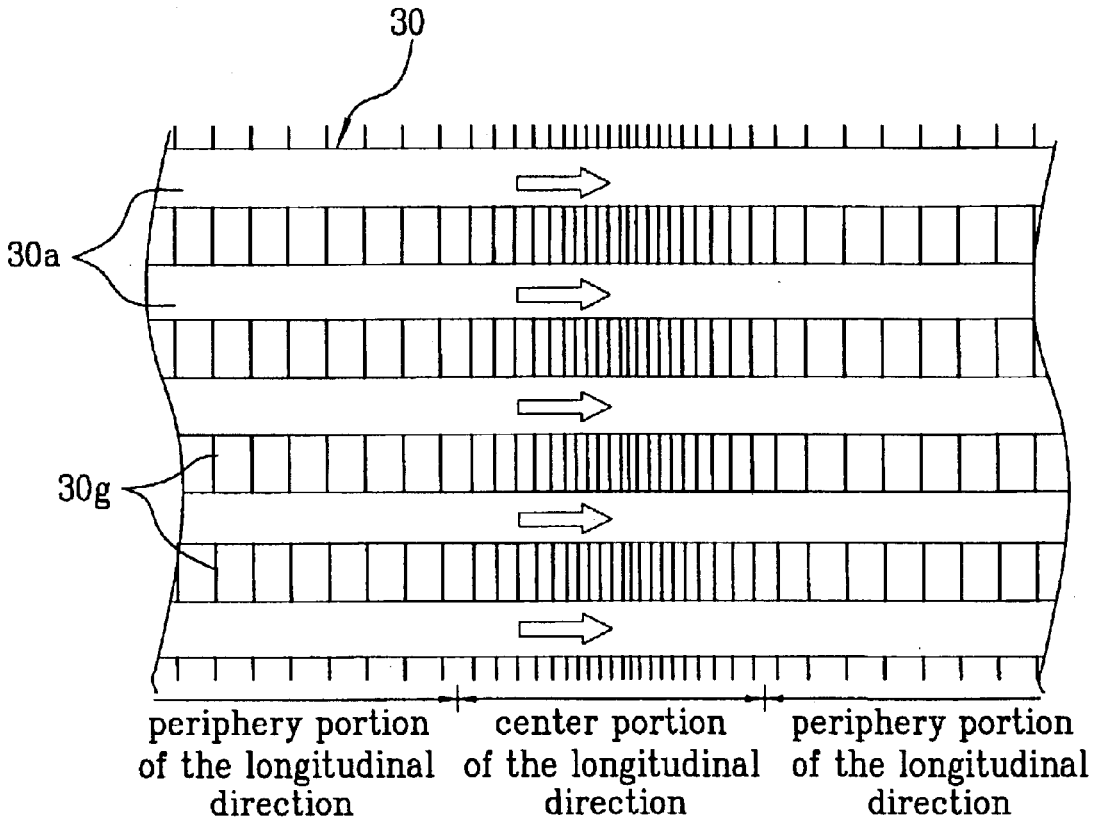
FIG. 10 is a side view illustrating an arrangement of cooling fins in a condenser according to the sixth embodiment of the present invention.

FIG. 8, FIG. 9 and FIG. 10 illustrate condensers according to the fourth, fifth, and sixth embodiments of the present invention. In the condensers according to the fourth to sixth embodiments of the present invention, the cooling fins 30*e*, 30*f*, and 30*g* of the condenser 30 are provided in a board type for being penetrated by the condensing duct 30*a*.

In the condenser according to the fourth embodiment of the present invention pitches of the cooling fins 30*e* gradually become wider as they move to a portion where air blown from the cooling fan 50 flows slowly. For example, as shown in FIG. 8, the pitches of the cooling fins 30*e* are narrow at the center portion of the longitudinal direction of the condenser 30 where air blown from the cooling fan 50 flows fast. Meanwhile, the pitches of the cooling fins 30*e* become wider as they move toward the periphery portions of the longitudinal direction of the condenser 30 where air blown from the cooling fan 50 flows slowly.

In the condenser according to the fifth embodiment of the present invention, pitches of the cooling fins 30*f* are equally narrow at a portion where air blown from the cooling fan 50 flows fast, and the pitches of the cooling fins 30*f* are equally wide at portions where air blown from the cooling fan 50 flows slowly. For example, as shown in FIG. 9, the pitches of the cooling fins 30*f* are equally narrow at the center portion of the longitudinal direction of the condenser 30 where air blown from the cooling fan 50 flows fast. Meanwhile, the pitches of the cooling fins 30*f* are equally wide at the periphery portions of the longitudinal direction of the condenser 30 where air blown from the cooling fan 50 flows slowly.

In the condenser according to the sixth embodiment of the present invention, pitches of the cooling fins 30*g* gradually become narrower as they move toward the center portion of the longitudinal direction of the condenser 30 where air blown from the cooling fan 50 flows fast. The pitches of the cooling fins 30*g* are equally wide at portions where air blown from the cooling fan 50 flows slowly. For example, as shown in FIG. 10, the pitches of the cooling fins 30*g* gradually become narrower as they move toward the center portion of the longitudinal direction of the condenser 30 where air blown from the cooling fan 50 flows fast. The pitches of the cooling fins 30*g* are equally wide at the periphery portions of the longitudinal direction of the condenser 30 where air blown from the cooling fan 50 flows slowly.

The heat-exchange of the condensers according to the preferred embodiments of the present invention will be explained as follows.

Air becomes high in humidity while drying the clothes in the drum. Then, the highly humid air is flown into the condensing duct 30*a* by circulating through the circulation duct 20. The cool air blown from the cooling fan 50 is flown into the portion having the cooling fins 30*b*, 30*c*, 30*d*, 30*e*, 30*f*, and 30*g* between the respective condensing ducts 30*a* through the duct 60. That is, the high humidity air flowing in the condensing duct 30*a* makes heat-exchange with the cool air through the medium of the outer surface of the condensing duct 30*a* and the cooling fins 30*b*, 30*c*, 30*d*, 30*c*, 30*f*, and 30*g*, so that the moisture of the high humidity air is condensed, thereby removing the moisture from the high humidity air.

An external air inlet A of the cooling fan 50 is narrower than an external air outlet B of the condenser 30. In this state, even though the flow speed of the external air changes, it is possible to improve heat-exchange efficiency by increasing a heat-exchange area since the interval or pitch of the cooling fins 30*b*, 30*c*, 30*d*, 30*e*, 30*f*, and 30*g* is narrow at the portion where the external air flows fast.

Thus, the interval or pitch of the cooling fins 30*b*, 30*c*, 30*d*, 30*e*, 30*f*, and 30*g* is narrow at the portion where the external air flows fast, so that the flow speed of the external air decreases when the external air passes through the portion where the interval or pitch of the cooling fins 30*b*, 30*c*, 30*d*, 30*e*, 30*f*, and 30*g* is narrow. Also, the interval or pitch of the cooling fins 30*b*, 30*c*, 30*d*, 30*e*, 30*f*, and 30*g* is wide at the portion where air blown from the cooling fan 50 flows slowly, so that the flow speed of air does not decrease even though the air passes through the portion where the interval or pitch of the cooling fins 30*b*, 30*c*, 30*d*, 30*e*, 30*f*, and 30*g* is wide. Referring to FIG. 5, the flow speed of air blown from the cooling fan 50 barely changes after passing through the condenser 30, thereby decreasing circulation noise because of smooth circulation.

Meanwhile, the condensing-type clothes dryer according to the present invention includes a circulation fan 70 for smoothly circulating the air in the circulation duct 20. The circulation fan 70 is rotated by the motor 40.

In the condensing-type clothes dryer according to the present invention, a heater (not shown) is provided in the circulation duct 20 for heating the circulation air. Also, a filter (not shown) is provided in the circulation duct 20 for filtering out particles such nap from the circulation air flowing in the circulation duct 20 after drying the clothes in the drum 10. A gutter (not shown) is provided below the condenser 30 for collecting condensed water generated during a condensing process step, and a pump (not shown) is provided for forcibly draining the condensed water collected in the gutter, or for circulating the condensed water to a condensed water tank (not shown) in the cabinet (not shown) having the drum 10.

The clothes dryer having the condenser according to the present invention is operated as follows.

First, the drum 10 is rotated with the rotation of the motor 40, so that the clothes are mixed in the drum 10. In this state, the circulation fan 70 is operated to circulate the air inside the drum 10, and the heater heats the circulating air. The heated circulating air becomes high in humidity during drying of the clothes being mixed in the drum 10, and the high humidity air is circulated through the circulation duct 20. At this time, the high humidity air is flown into the condensing duct 30*a* of the condenser 30, thereby making heat-exchange with the cool air blown from the cooling fan 50. That is, the moisture is removed from the high humidity air through the condensing process step. After that, the dry air is heated in the heater, and then the heated air is flown into the inside of the drum 10 so as to dry the clothes. In this state, particles such as the nap in the circulating air are filtered through the filter. The condensed water being collected in the gutter is drained to the outside, or is stored in the condensed water tank.

Accordingly, the clothes dryer having the condenser according to the present invention has the following advantages.

First, the condenser according to the present invention has good heat-exchange efficiency. Thus, it is possible to perfectly remove the moisture from the humid circulation air, thereby improving drying efficiency.

Also, the flow speed of the external air passing through the condenser after being blown from the cooling fan is barely changed, thereby decreasing circulation noise by the smooth circulation.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A condenser of a condensing-type clothes dryer comprising:

a cooling fan, directing air to portions of a condenser, said fan directing a greater amount of air to a center portion of the condenser than to other portions of the condenser;

a plurality of condensing ducts provided in a middle portion of a circulation duct, the condensing ducts condensing air being circulated there-through after being discharged from a drum; and a plurality of cooling fins provided to be in contact with an outer surface of the condensing ducts, wherein an interval or a pitch of the cooling fins is different partially according to an amount of air directed to said portions by said cooling fan.

2. The condenser as claimed in claim 1, wherein the pitch or interval of the cooling fins is narrow at a portion where an amount of air directed from said cooling fan is the greatest, and the pitch or internal of the cooling fins is wide at a portion where an amount of air directed from the cooling fan is the least.

3. The condenser as claimed in claim 2, wherein the cooling fin has a longitudinal-section of a waveform, which is provided between the condensing ducts.

4. The condenser as claimed in claim 3, wherein the pitches of the cooling fins gradually become wider as they near the portion where air directed from said cooling fan is the least.

5. The condenser as claimed in claim 3, wherein the pitches of the cooling fins are equally narrow at the portion where an amount of air directed from said cooling fan is the greatest, and the pitches of the cooling fins are equally wide at the portion where an amount of air directed from said cooling fan is the least.

6. The condenser as claimed in claim 3, wherein the pitches of the cooling fins gradually become narrower as they near the center portion of a longitudinal direction of the condenser where an amount of air directed from said cooling fan is greatest, and the pitches of the cooling fins are equally wide at portions where an amount of air is least.

7. The condenser as claimed in claim 2, wherein the cooling fins are provided in a board type for being penetrated by the condensing duct.

8. The condenser as claimed in claim 7, wherein the intervals of the cooling fins gradually become wider as they near the portion where an amount of air directed from said cooling fan is least.

9. The condenser as claimed in claim 7, wherein the intervals of the cooling fins are equally narrow at the portion where an amount of air directed from said cooling fan is the greatest, and the intervals of the cooling fins are equally wide at a portion where an amount of air directed from said cooling fan is least.

10. The condenser as claimed in claim 7, wherein the intervals of the cooling fins gradually become narrower as they near the center portion of the longitudinal direction of the condenser where an amount of air directed from said cooling fan is greatest, and the pitches of the cooling fins are equally wide at the portion where an amount of air is least.

11. A condensing-type clothes dryer comprising:

a drum being rotatably provided in a cabinet;

a circulation duct connecting an air inlet and outlet of the drum with each other for forming a circulation passage of air inside the drum;

a condenser having a plurality of circulation ducts being provided in a middle portion of the circulation duct for condensing air being flowing there-through after being discharged from the outlet of the drum, and a plurality of cooling fins provided to be in contact with an outer surface of the condensing ducts, wherein an interval or a pitch of the cooling fins is different partially according to an amount of air provided at a portion of the condenser;

a cooling fan provided at one side of the condenser for cooling the condenser and providing air to portions of the condenser; and a motor driving the drum and the cooling fan.

12. The condensing-type clothes dryer as claimed in claim 11, wherein the pitch or interval of the cooling fins is narrow at a portion where an amount air provided from the cooling fan is greatest, and the pitch or internal of the cooling fins is wide at a portion where an amount of air provided from the cooling fan is least.

13. The condensing-type clothes dryer as claimed in claim 12, wherein the cooling fin has a longitudinal-section of a waveform having pitches, which is provided between the condensing ducts.

14. The condensing-type clothes dryer as claimed in claim 13, wherein the pitches of the cooling fins gradually become wider as they near the portion where an amount of air provided from the cooling fan is least.

15. The condensing-type clothes dryer as claimed in claim 13, wherein the pitches of the cooling fins are equally narrow at the portion where an amount of air provided from the cooling fan is greatest, and the pitches of the cooling fins are equally wide at the portion where an amount of air provided from the cooling fan is least.

16. The condensing-type clothes dryer as claimed in claim 13, wherein the pitches of the cooling fins gradually become narrower as they near the center portion of a longitudinal direction of the condenser where an amount of air provided from the cooling fan is greatest, and the pitches of the cooling fins are equally wide at portions where an amount of air provided from the cooling fan is least.

17. The condensing-type clothes dryer as claimed in claim 12, wherein the cooling fins are provided in a board type for being penetrated by the condensing duct.

18. The condensing-type clothes dryer as claimed in claim 17, wherein the intervals of the cooling fins gradually become wider as they near the portion where an amount of air provided from the cooling fan is least.

19. The condensing-type clothes dryer as claimed in claim 17, wherein the intervals of the cooling fins are equally narrow at the portion where an amount of air provided from the cooling fan is greatest, and the intervals of the cooling fins are equally wide at the portion where an amount of air provided from the cooling fan is least.

20. The condensing-type clothes dryer as claimed in claim 17, wherein the intervals of the cooling fins gradually become narrower as they near the center portion of the longitudinal direction of the condenser where an amount of air provided from the cooling fan is greatest, and the pitches of the cooling fins are equally wide at portions where an amount of air provided from the cooling fan is least.

* * * * *